United States Patent [19]

Anderson

[11] Patent Number: 4,590,854

[45] Date of Patent: May 27, 1986

[54] SCREEN PRINTING METHOD AND APPARATUS

[76] Inventor: Ronald C. Anderson, 1315 Avon Dr., Connellsville, Pa. 15425

[21] Appl. No.: 597,503

[22] Filed: Apr. 6, 1984

[51] Int. Cl.[4] ..... B41F 17/08; B41F 17/38; B41F 15/40; B41L 13/18

[52] U.S. Cl. ..... 101/35; 101/114; 101/115

[58] Field of Search ..... 101/114, 115, 127.1, 101/123, 35

[56] References Cited

U.S. PATENT DOCUMENTS

| | | | |
|---|---|---|---|
| 576,623 | 2/1897 | Schreurs . | |
| 798,528 | 8/1905 | Ostwald . | |
| 804,425 | 11/1905 | Mountford | 101/115 |
| 1,894,530 | 1/1933 | Bernardo | 101/114 |
| 2,034,003 | 3/1936 | Shurley | 101/115 |
| 2,152,274 | 3/1939 | Papazian | 101/114 |
| 2,203,457 | 6/1940 | Dichter | 101/114 |
| 2,484,671 | 10/1949 | Bauman | 101/114 |
| 2,547,554 | 4/1951 | Beckelman | 101/114 |
| 2,904,916 | 9/1959 | Stahmann | 101/114 |
| 3,172,358 | 3/1965 | Weiss | 101/126 |
| 3,221,648 | 12/1965 | Weiss | 101/129 |
| 3,294,018 | 12/1966 | Heonis | 101/115 |
| 3,372,638 | 3/1968 | Tripp | 101/114 |
| 3,374,731 | 3/1968 | Thorne | 101/124 |
| 3,427,964 | 2/1969 | Vasilantone | 101/115 |
| 3,460,470 | 8/1969 | Green | 101/115 |
| 3,744,922 | 7/1973 | Fears | 101/114 |
| 3,745,970 | 7/1973 | Scantlebury | 118/50 |
| 4,048,918 | 9/1977 | Peck | 101/114 |
| 4,084,504 | 4/1978 | Fuchs | 101/115 |
| 4,164,183 | 8/1979 | Peck | 101/114 |
| 4,266,476 | 5/1981 | Maloof | 101/35 |
| 4,314,503 | 2/1982 | Perra, Jr. et al. | 101/41 |
| 4,381,706 | 5/1983 | Harpold | 101/127.1 |

FOREIGN PATENT DOCUMENTS

| | | | |
|---|---|---|---|
| 1175156 | 3/1959 | France | 101/114 |
| 591691 | 4/1959 | Italy | 101/114 |
| 660210 | 2/1964 | Italy | 101/114 |
| 362891 | 6/1930 | United Kingdom | 101/114 |
| 262117 | 1/1970 | U.S.S.R. | 101/114 |
| 0921879 | 4/1982 | U.S.S.R. | 101/114 |

OTHER PUBLICATIONS

"Product Information Catalog," KC Graphics, Inc., Kansas City, Kans. pp. 238–239.

"Screen Printing Supplies & Equipment", The Jay Products Company, Cincinnati, Ohio, pp. 48–60.

*Primary Examiner*—Edgar S. Burr

*Assistant Examiner*—William L. Klima

*Attorney, Agent, or Firm*—Webb, Burden, Robinson & Webb

[57] ABSTRACT

A direct printing method and apparatus includes one or a plurality of machines for printing indicia in single or multiple colors on a substrate, such as a cap or a T-shirt. The method involves forcing ink in the form of a viscous composition under pressure through a pattern in a screen in contact with the substrate. The apparatus includes means for holding the substrate, means for providing the contact between the screen and the substrate, and means for supplying air to the ink for a time and at a pressure appropriate to force the ink through the screen pattern to form a non-distorted detailed design on the substrate.

20 Claims, 19 Drawing Figures

SCREEN PRINTING METHOD AND APPARATUS

BACKGROUND OF THE INVENTION

1. Field of the Invention

This invention relates to a method and apparatus for applying indicia such as designs, letters, numbers and/or words on substrates. Particularly, the invention relates to a method and apparatus for directly printing indicia in the form of designs, letters, numbers and/or words, for example, on caps, hats, T-shirts and the like for identification, information, promotion, and/or aesthetic purposes but is not limited to any specific indicia or type of substrate. More particularly, the invention relates to printing such designs, letters and/or words on substrates with the use of a curved screen and apparatus which incorporates a curved screen.

2. Description of the Prior Art

For many, many years indicia in the form of, for example, designs, letters, numbers and/or words have been applied to substrates for purposes of identification, information, promotion, or aesthetic purposes. Such substrates especially included hats, caps, T-shirts and other articles of clothing whereby the wearer could identify or be identified with a particular group, cause, club and the like. In addition, logos have been printed on caps or hats for purposes of advertising or information. Similarly, an infinite number of designs have been applied to articles of clothing for aesthetic, informational or other purposes.

Early processes and apparatus for printing and dyeing fabrics are disclosed in U.S. Pat. Nos. 576,623 and 798,528.

Although the usual techniques for applying such indicia to substrates were somewhat elementary, for example, the use of stencils on containers or the like, or heat transfers for articles of clothing, the wide acceptance of indicia on clothing articles has prompted persons in the art to search for better methods and apparatus for applying indicia to clothing articles so that the detail of the designs is maintained and the design on the articles presents a professional appearance.

Various techniques which have been used include the process and apparatus disclosed in U.S. Pat. No. 3,745,970 wherein a diaphragm carrying a pattern is forced by air into engagement with a plate for coating an article, and portable stenciling apparatus using a process as described in U.S. Pat. Nos. 4,048,918 and 4,164,183.

The attempt to obtain expert design in detail is complicated by the fact that some of the surfaces to be printed are curved or at least not perfectly planar. Special apparatus has been designed for printing such curved or irregular surfaces, such as that described in U.S. Pat. No. 4,314,503. This is particularly true in the case of hats or caps where printing of the indicia on the head band is required after the hat is manufactured.

A recent method and apparatus for printing curved surfaces described in U.S. Pat. No. 4,381,706 comprise a frame having a curved printing screen. The device is designed for printing indicia on caps and hats using a squeegee. Although the method and apparatus described in the patent are said to overcome the difficulties of pattern distortion experienced in the art, there are still pattern distortions with the use of the patented method and apparatus.

The present method and apparatus overcome these deficiencies and produce a non-distorted, detailed image on a substrate, either curved, planar or irregular, such as a cap, hat, T-shirt or the like.

SUMMARY OF THE INVENTION

The present invention is addressed to a method and apparatus for directly producing a printed design on a substrate by forcing ink through a predetermined pattern on a screen in contact with a surface of the substrate to be printed. The force is supplied by gas under pressure, preferably air at constant pressure. The ink is in the form of a substantially viscous composition and preferably in the form of a plastisol which is commercially available. The screen, which is also commercially available, is supported by a screen frame such that the contour of the screen is substantially the same as the contour of the surface to be printed. A single color or multi-color designs can be applied to the substrate using one or more frames mounted in substantial alignment with each other or mounted for indexing, preferably with means for drying the image after application being provided with the multiple applications.

The invention will be better understood from the following description of the invention taken in conjunction with the accompanying drawings wherein like numerals identify like elements.

DESCRIPTION OF PRESENTLY PREFERRED EMBODIMENTS OF THE INVENTION

FIGS. 1–5 illustrate the preferred apparatus comprising one machine M for directly printing indicia on caps according to the method of the invention.

Figure 1:
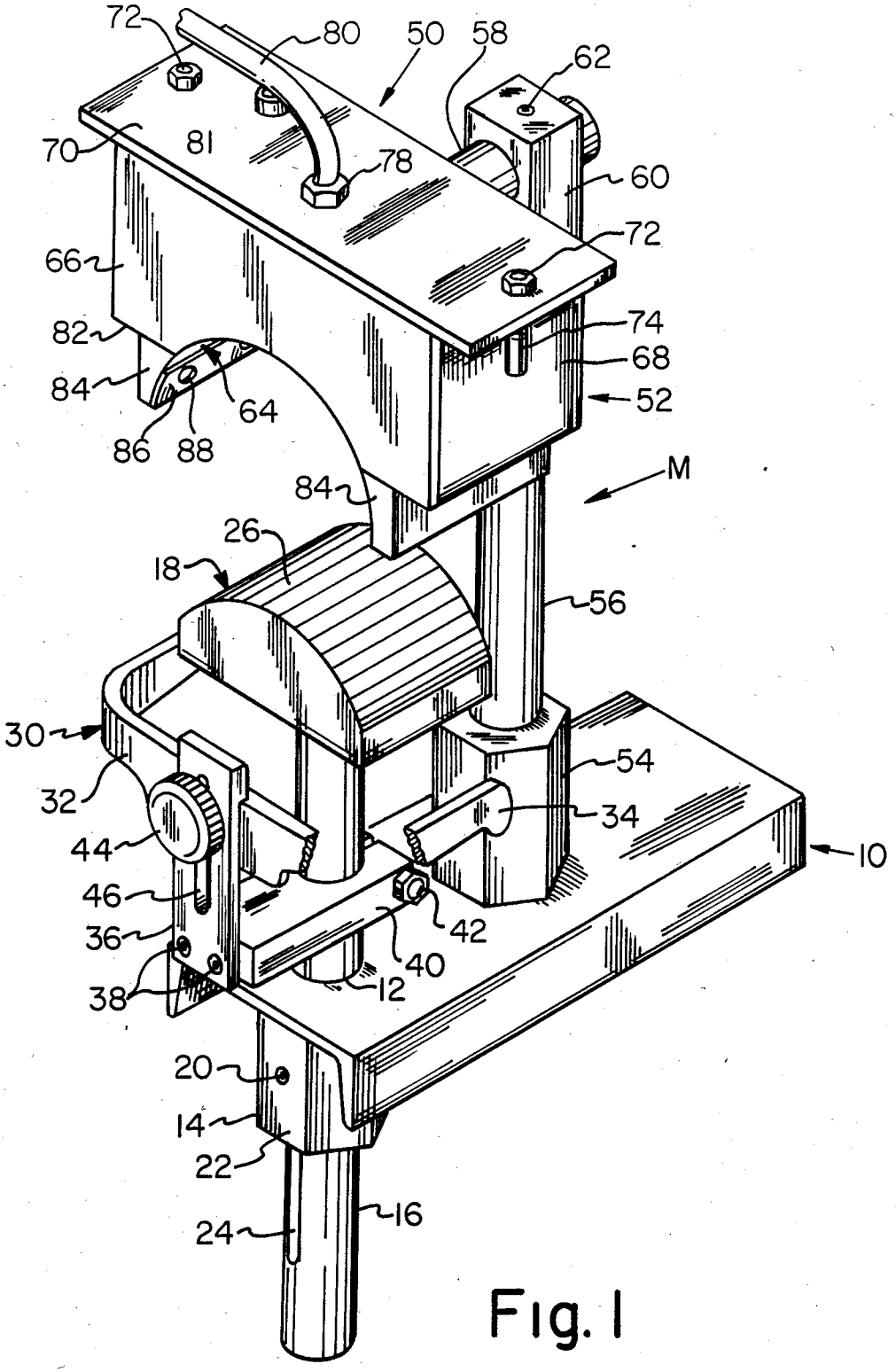
FIG. 1 is an isometric view of a first and preferred embodiment of my screen printing apparatus in the form of one machine according to the invention for printing curved surfaces.
Figure 2:
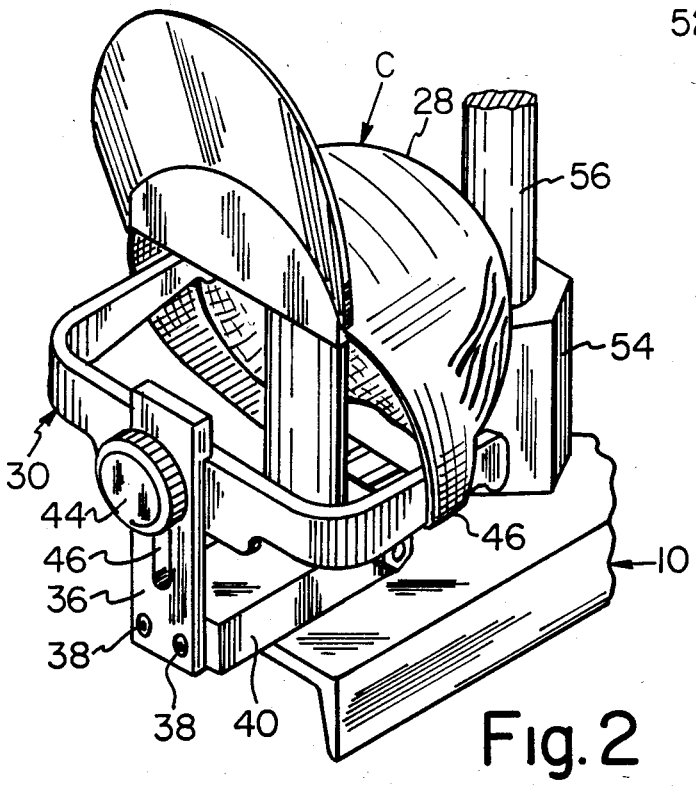
FIG. 2 is a partial view showing a cap positioned on a mandrel of the device.

Referring to FIGS. 1 and 2, the machine M includes a base 10 which may be constructed of a wide channel or table of suitable material and configuration. The base 10 is stationary relative to the rest of the machine. An aperture 12 is provided on one end of the base. A journal block 14 having an aperture therein aligned with aperture 12 in the base is secured to the lower surface of the base 10 by welding or the like. A vertically adjustable post 16 extends through the apertures in the block 14 and base 10 and supports a mandrel 18 at the upper end thereof. A fastener 20 extends through a side wall 22 of the block 14 into a vertical slot 24 in the post 16 and prevents rotation of the post 16 relative to the block 14 and the base 10.

A curved upper surface 26 is provided on the mandrel 18 for supporting a cap C, as more particularly shown in FIG. 2, wherein the inner curved surface of the front head band 28 of the cap rests on the corresponding curved surface 26 of the mandrel 18.

A cap hold down ring 30 in the form of a U-shaped member 32 having stops 34 at the outwardly extending ends is mounted on an upstanding hold down plate 36 fastened by Allen head screws 38 to a cap hold down base 40 mounted on the post 16. The plate 36 is adjustably secured to the post 16 by machine bolt 42 which secures the split ends of base 40 to the post 16.

The member 32 of the cap hold down ring 30 is adjustably secured to the hold down plate 36 by a hold down knob 44 which threadably engages the member 32 through a slot 46 in the plate 36. Thus, once the position of the hold down base 40 is fixed on post 16 relative to the mandrel 18, the hold down ring 30 is vertically adjustable relative to the mandrel 18. After the cap C is positioned over the mandrel, the knob 44 is loosened, vertically lowering the hold down ring 30 to engage the back band 48 of a cap C, as shown in FIG. 2, to pull the front head band 28 tightly into engagement with the curved surface 26 of the mandrel 18. The stops 34 on the ring 30 prevent the back band 48 of the cap C from slipping off the member 32. Once the cap band is so engaged the knob 44 is tightened to engage member 32 against the plate 36 for printing of the cap C.

Base 10 also supports the printing head 50 including the housing 52 which is vertically aligned with the mandrel 18. The supporting means includes a block 54 fixed to the base 10 at the end opposite the aperture 12 for supporting a vertical post 56. A two-part lateral beam 58 having a circular cross section extends into and is supported by a block 60 at the upper end of post 56. One end of the lateral beam 58 is secured in the block 60 by a fastener 62 as will be described in detail hereinafter with respect to FIG. 6.

Figure 6:
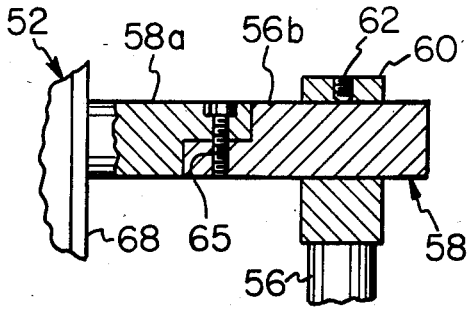
FIG. 6 is a detailed view showing the connection between the housing to the vertical part of the apparatus.

Housing 52 is secured to the opposite end of the lateral beam 58. Thus, the position of the housing 52 relative to the base 10 is fixed such that a cap C on the mandrel 18 which is secured to the post 16 can be brought into contact with a screen 64 secured to the lower part of the housing 52. To insure that the contact between the cap C and the screen 64 is substantially uniform across the screen the housing 52 may be moved inwardly and outwardly with respect to block 60 on beam 58 which extends through block 60 and is rotatable about beam 58. As shown in FIG. 6, the beam 58 is formed of two parts 58*a* and 58*b* which are connected to each other by fastener 65. At one end part 58*a* is welded to the rear side wall 66 of the housing 52; at the opposite end part 58*b* extends through block 60 and is retained by a fastener, such as set screw 62.

As more particularly shown in FIGS. 1–5, the housing 52 comprises a rectangular box-like structure having a pair of end walls 68 and a pair of side walls 66. The top of the structure is closed by a removable lid 70 which is secured by nuts 72 on threaded posts 74 welded to the end walls 68 of the housing 52. A threaded nipple 76 with a compression fitting nut 78 is placed in the lid 70 to provide an air passage into the structure. One end of a flexible hose 80, which may be made of plastic, rubber or other suitable conventional material, is affixed to the nipple. The opposite end of the hose may be connected to a source of air. A standard pressure relief valve 81 may be provided in the lid.

The bottom wall 82 of the structure is open and is provided with a pair of laterally extending screen support members 84 having a curved inner surface to which a screen 64 having a frame 86 is secured by fasteners, such as screws 88.

Figure 8:
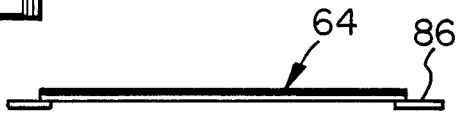
FIG. 8 is a side elevational view of the screen frame and screen of FIG. 7.
Figure 7:
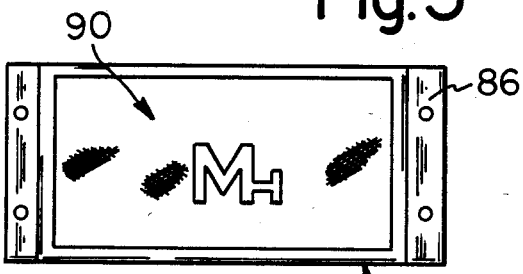
FIG. 7 is a plan view of the screen frame and screen in an extended position.

The screen 64 and screen frame 86 are shown in FIGS. 7 and 8 and may be purchased. For example, a suitable screen and frame are available from Harco under its number HP-14F (frame only) or HP-14FS (frame with fabric screen). The screen mesh is preferably 200 line screen monofilament fabric, but any suitable mesh and fabric screen may be used.

The screen is stretched tightly between the support members 84 and carries a pattern such as the "MHI" indicia shown at 90 in FIG. 7, which is desired to be printed onto the cap front head band 28 or the like.

The preparation of the screen pattern 90 is conventional and well known to those skilled in the art. Essentially, the screen is coated with a photosensitive emulsion and a film positive sandwiched against it. The film is exposed to high intensity light to fix the non-image or non-pattern area which hardens to a greater extent than does the pattern area which remains relatively soft since it is opaque to the film positive. The screen is then washed out with water cleaning the soft, unexposed pattern to create the photostencil image to be printed on the cap. Different screens and different patterns can be used as desired.

Preparatory to printing with the device according to the invention, a mass of ink 91 in the form of a viscous composition is placed on the upper surface of the screen 64 over the image or pattern area. The manner of charging the ink is incidental to the method and can be done by dipping ink from a container using a spatula or the like.

The preferred ink is in the form of a plastisol such as Wilflex SSV-LF/H4 ink which is characterized by the manufacturer as a super opaque/non-bleeding vinyl plastisol screen printing ink, which is especially formulated for direct screen applications. Other suitable inks include Wilflex SSV-LF general purpose vinyl plastisol screen printing ink. Other inks are suitable provided they are in a relatively viscous state so that they will normally adhere to the upper surface of the screen. In addition to plastisols, water base inks and enamels, for example, can also be used provided they are adequately thickened, for example, using a thickener such as starch or the like. The consistency of other ink can be modified in other ways well known in the art for use in the method and apparatus of the invention.

During printing, the ink mass is forced by compressed air introduced through hose 80 into the air chamber formed by housing 52, through the screen pattern 90 and onto the fabric of the cap which is previously raised into contact with the lower surface of the screen 64. The air pressure used to print is preferably about 6 psi but it may be more or less depending upon the type and consistency of the ink, the screen fabric and mesh, the substrate fabric upon which the printing is to be done, the time for printing, and the detail desired in the final design.

Air is provided from a conventional source such as an air compressor (not shown). The printing pressure is regulated in a control unit 92 such as that shown in FIGS. 9–12. The control unit 92 comprises preferably a rectangular box 94 having an air inlet 96 through which air enters the unit at a pressure of about 30–40 psi. The air passes through tube 98 to an air regulator 100 having a pressure gauge 102, which can be observed from the front of the unit, and then through an air flow valve 104 to an air outlet 106 to which an end of air hose 80 is attached. The regulator 100 is controlled by a knob 108 which also extends through the front of the box 94.

The unit 92 is activated by a power on button control 110 and start button control 112 electrically connected to the valve 104 through the bus element 114 and fuse element 116, which are connected to a power source (not shown) through box receptacle 117. An emergency stop button control 118 is also provided in the electrical circuit and accessible from the front of the control unit 92. The details of the electrical circuit are well known and need not be described in further detail.

To print an image, ink is forced under the regulated air pressure through the screen 64 for a specified predetermined time which is controlled by a timer 120 of the control unit 92. Preferably for a 6 psi air pressure, the printing time is approximately two seconds. Of course, the printing time also is dependent upon the air pressure, ink consistency and image detail required.

Figure 11:
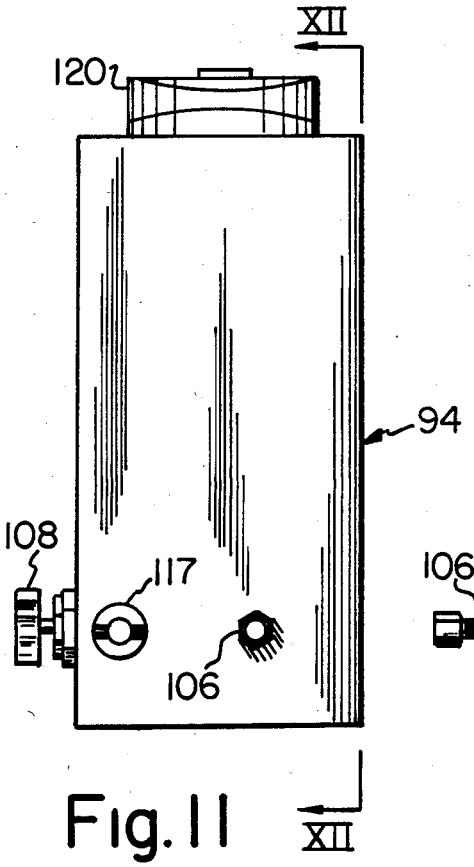
FIG. 11 is a side elevational view of the unit of FIG. 9.
Figure 12:
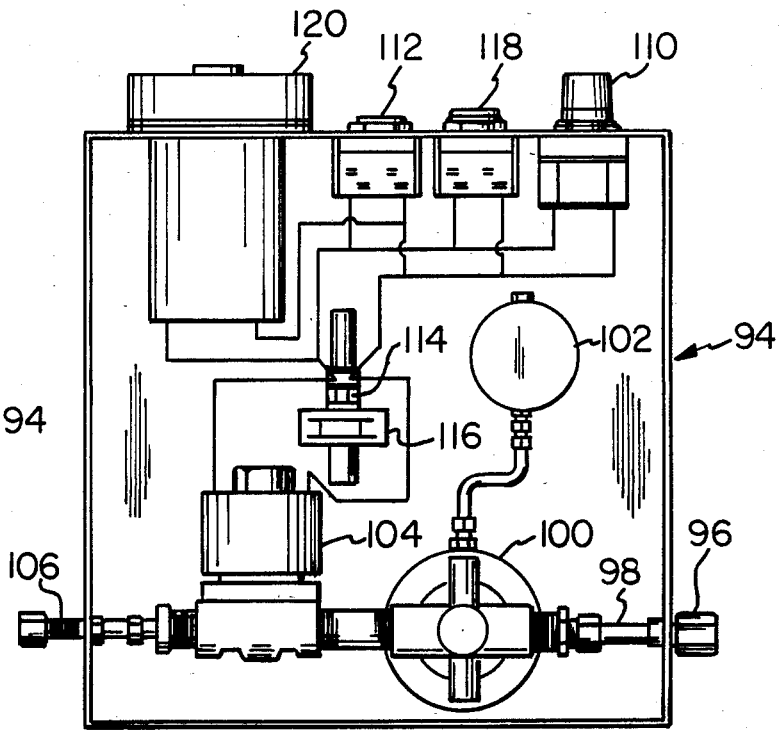
FIG. 12 is a rear view of the control unit of FIG. 9 with the rear panel removed taken along lines XII—XII of FIG. 11.
Figure 9:
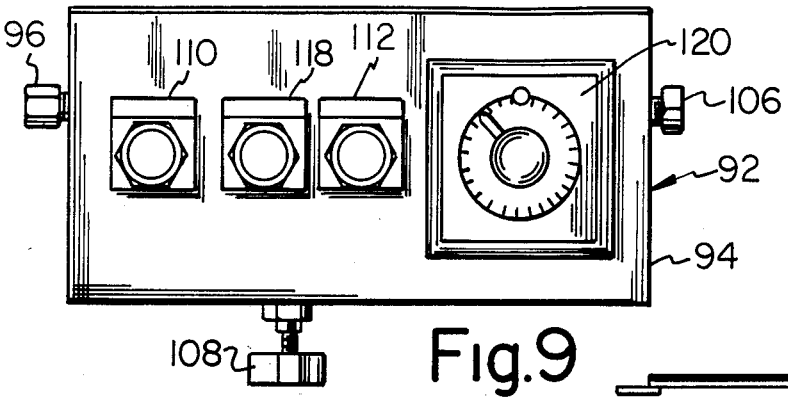
FIG. 9 is a top plan view of the control unit for the apparatus.
Figure 10:
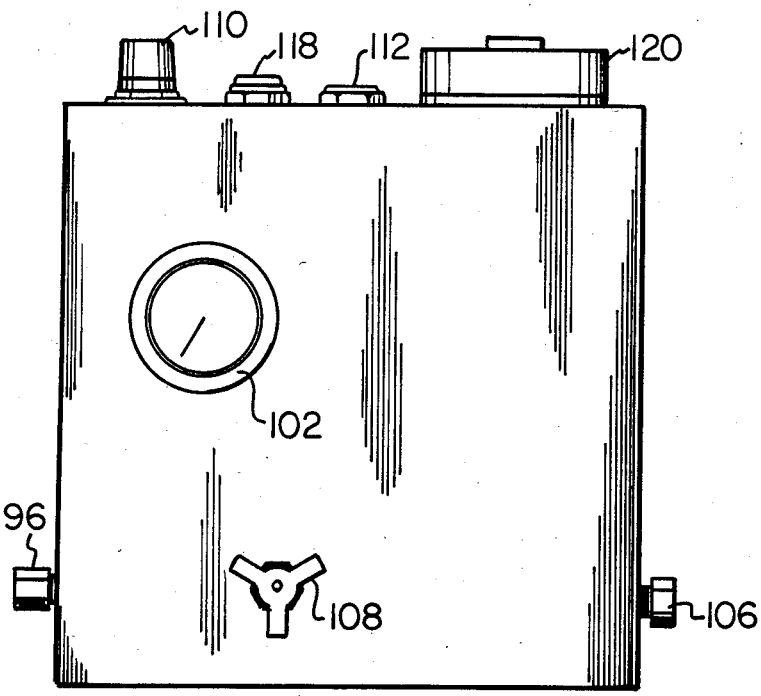
FIG. 10 is a front elevational view of the unit of FIG. 9.
Figure 5:
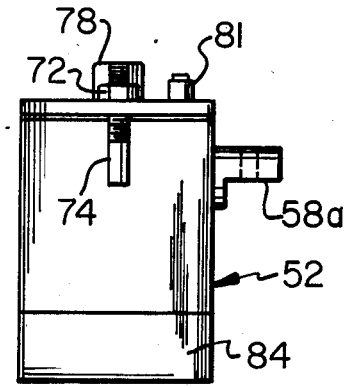
FIG. 5 is an end elevational view of the housing of FIG. 3.
Figure 3:
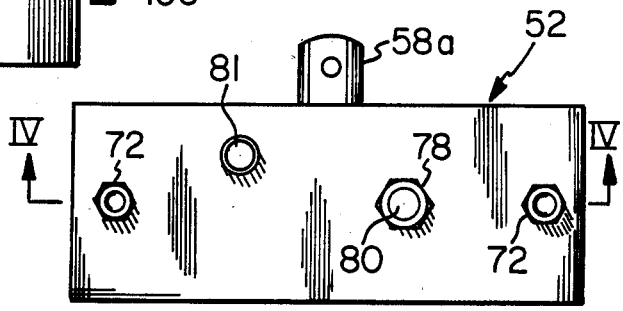
FIG. 3 is a top view of the assembled air chamber housing and screen mount in the apparatus of FIG. 1.
Figure 4:
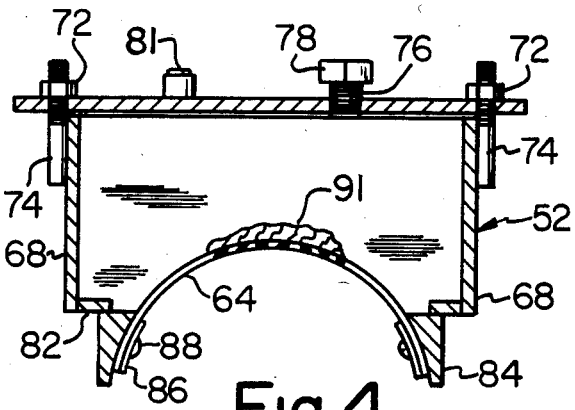
FIG. 4 is a cross-sectional view taken along lines IV—IV of FIG. 3.

As shown in FIGS. 9–11, the control unit 92 is self-contained and air pressure, time and regulator controls are both easily visible and accessible. Again, the unit 92 may have a different configuration from that illustrated so long as provision is made for regulating the time and pressure for admitting air into the housing 52 of the printing head 50 to force the ink through the pattern and onto the substrate, e.g. cap to be printed. Quick disconnect couplings or other connections, including threaded couplings, can be provided for the air lines or hoses.

OPERATION

The operation of a printing machine according to the invention is as follows: The lid 70 of the printing head or housing 52 is removed by removing the nuts 72 and a supply of viscous ink 91 is placed on the screen 64 so as to completely cover at least the image or pattern area. Of course, it may extend beyond that area. The lid 70 is replaced and the nuts 72 threaded and tightened on the posts 74. Wing nuts are preferable for the nuts 72 since they can be operated easily by hand.

The mandrel 18 holding the cap C to be printed is raised such that the surface 26 is put into contact with the screen 64 and secured. The mandrel 18 can be raised by hand by grasping the cap hold ring 30 and lifting it or the post 16 carrying the mandrel 18 can be raised automatically using a hydraulic or pneumatic cylinder, operated for example by a conventional foot treadle control, to raise the mandrel and bring the surface of the cap front band 28 to be printed into contact with the lower edge of the screen. Of course, it is also within the scope of the invention to maintain the substrate in a stationary position relative to the floor and lower the printing head until the screen contacts the substrate.

Air at approximately 6 psi constant pressure is then supplied to the printing head 50 by pressing start button control 112, forcing the ink through the screen 64 in the pattern area to print the desired image on the cap C. The mandrel 18 is then released and lowered and the printed cap is removed from the hold down ring 30 by turning knob 44 to permit the cap back band 48 to slide over the ends of the U-shaped ring member 32.

The image produced on the cap has excellent detail without any distortion since all pressure is applied vertically, as distinguished from prior methods which utilize a squeegee which causes image distortion due to the movement of the screen surface and/or surface of the fabric being printed. The direct printing machine is used to produce an image in a single color or a portion of an image of multiple colors.

Figure 13:
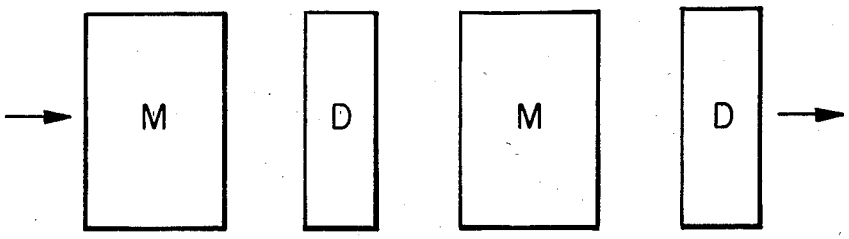
FIG. 13 is a schematic view of a plurality of machines aligned to form a direct printing apparatus in accordance with the invention.

For multi-colored printing, a plurality of machines M, each constructed in accordance with the description of the single machine set forth above, are provided to form a direct printing apparatus. In one aspect of the invention schematically shown in FIG. 13, a series of machines are aligned in a substantially straight line and the substrate, i.e. a cap to be printed, is moved from machine to machine, i.e. from station to station. At each station a different color image or portion thereof is printed on the substrate. Preferably, conventional dryers, such as spot dryers D, are positioned between the machines to completely dry or cure the ink of the design previously applied before additional ink is printed on the substrate.

Figure 14:
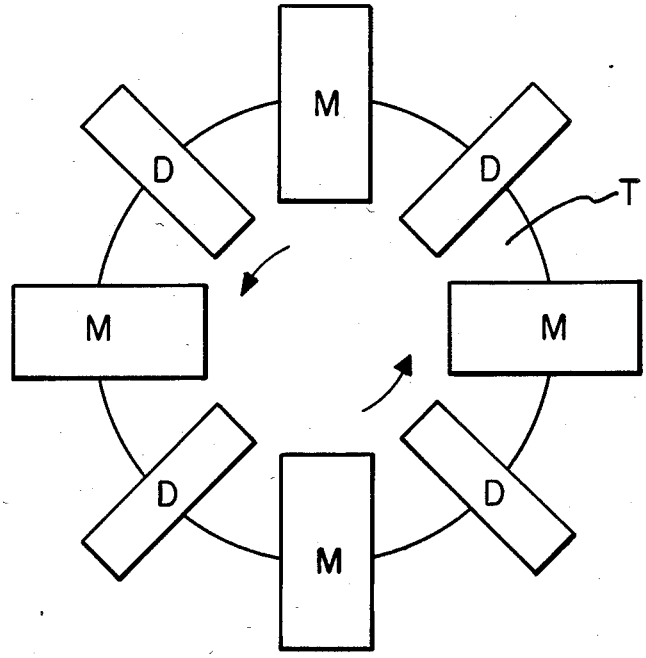
FIG. 14 is a schematic view of a plurality of machines arranged in a circular fashion to form a direct printing apparatus in accordance with the invention.
Figure 15:
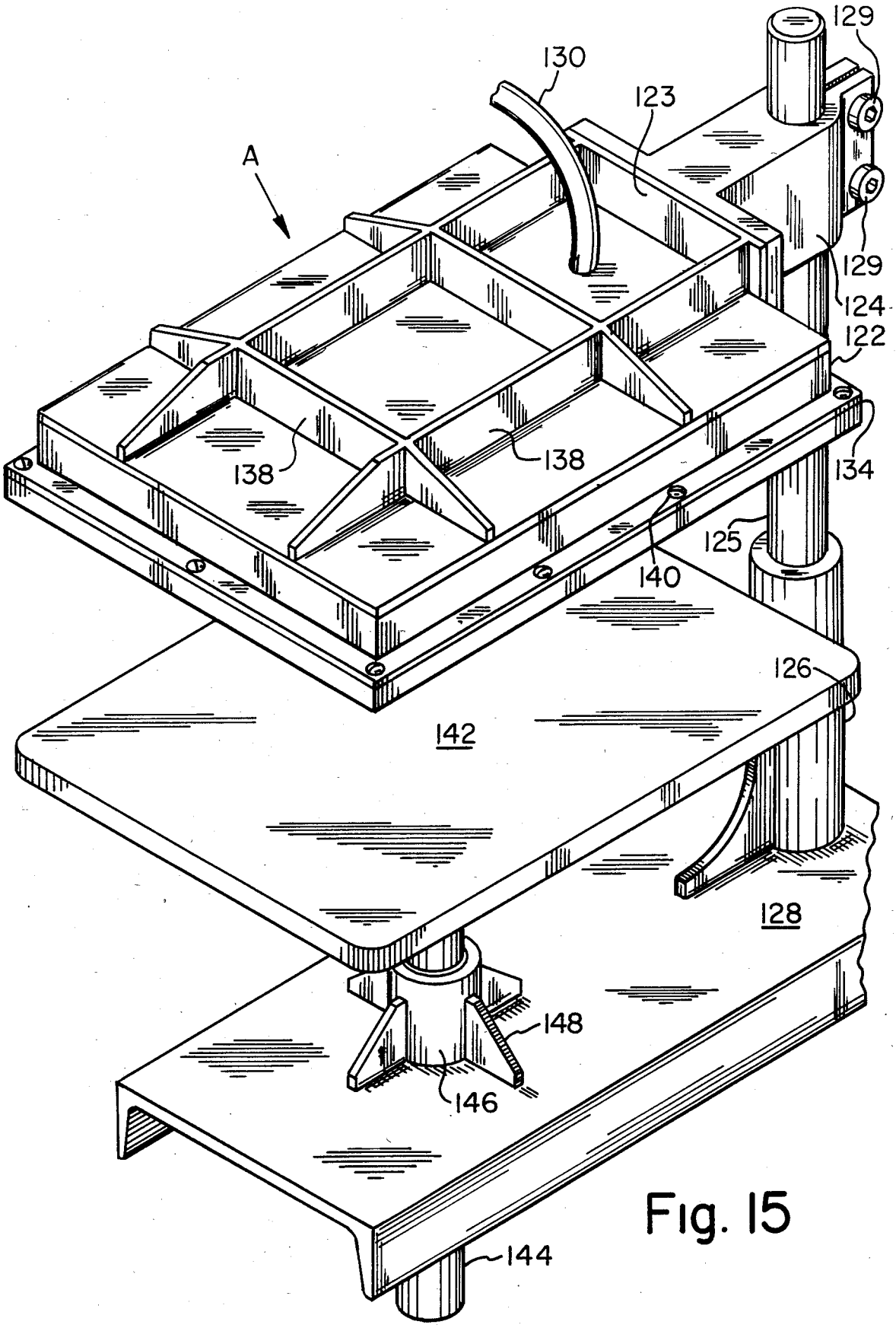
FIG. 15 is an isometric view of a second embodiment of the invention for printing planar or substantially planar surfaces.
Figure 16:
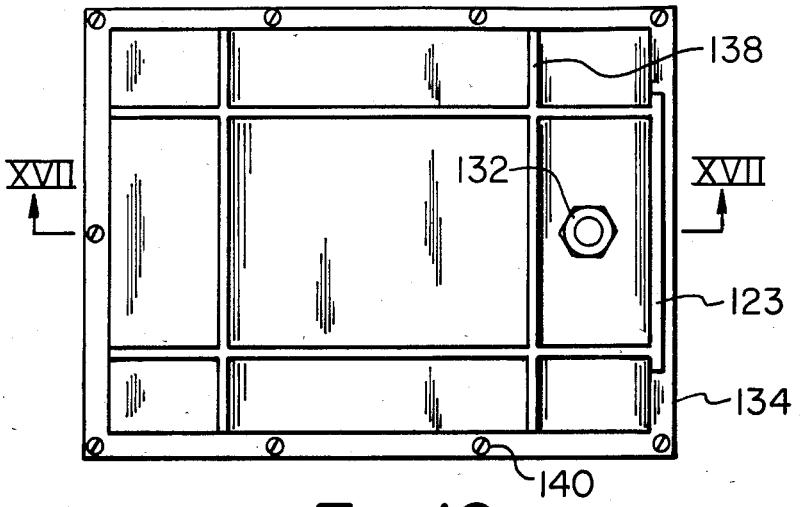
FIG. 16 is a top plan view of the housing for the apparatus shown in FIG. 15.
Figure 17:
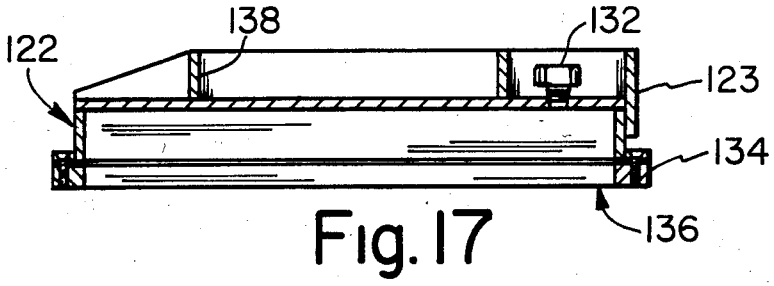
FIG. 17 is a cross-sectional view of the housing taken along lines XVII—XVII of FIG. 16.
Figure 19:
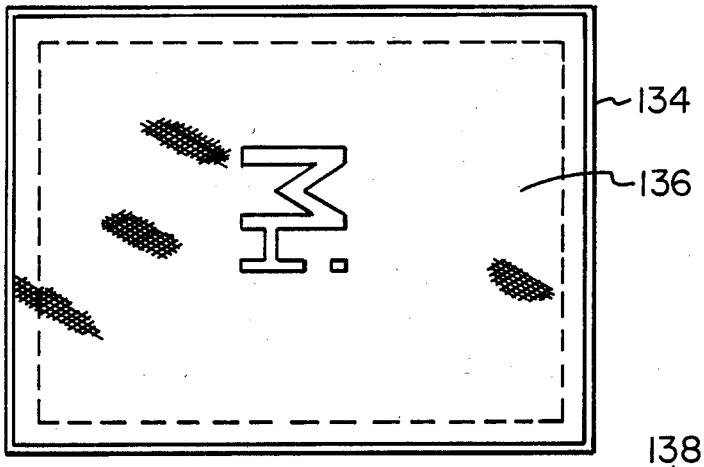
FIG. 19 is a bottom plan view of the screen for the housing shown in FIG. 16.
Figure 18:
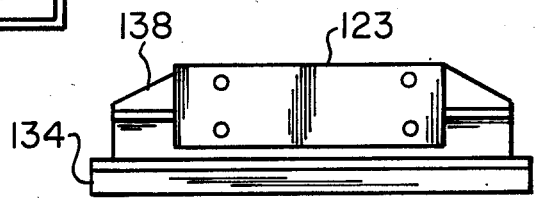
FIG. 18 is an end elevational view of the housing shown in FIG. 16.

In another aspect of multi-colored printing according to the invention, a plurality of printing machines M, such as shown in FIG. 1, may be positioned in a circular fashion to form a direct printing apparatus. For example, a rotatable table T as shown in FIG. 14 may be provided and adapted to be indexed to permit a single operator to load the substrate to be printed on the machine, print multiple colored images or portions thereof automatically, and remove them at the same or a different station. Again, spot dryers D or the like may be provided between the individual machines M to cure the printed ink before printing additional designs or portions thereof.

As in the case of the single machine, the multi-machine apparatus is controlled automatically with respect to the amount of air pressure and time required depending upon the screen mesh or meshes utilized, the print pattern or patterns, and ink or inks used. Since different screens and patterns are used, each station in the multi-color machine apparatus preferably has separate controls including an adjustable pressure regulator and gauge, electrically operated three-way valve, and electrically operated timer or equivalent. Of course, all of the controls can be physically housed in a single control unit for the convenience of the operator.

Where a single or multiple-color apparatus is used for printing caps, it is desirable to provide a supply of ink which is adequate to print at least 50 caps before reloading is required. Of course, a greater or lesser ink supply may be provided.

By way of example and not by way of limitation, three examples of direct cap printing according to the invention will be described.

EXAMPLE I

A 100% polyester smooth front banded baseball cap C is to be printed with an indicia such as the "MHI" indicia shown in FIG. 7. A 200 line monofilament fabric screen 64 is secured in the printing head housing 52. A mass of Wilflex SSV-LF/H4 plastisol ink is placed on the inside surface of the screen over the pattern area. The cap band on a mandrel 18 is moved into contact with the lower edge of the screen. Air under 6 psi pressure is forced against the ink for 1½ seconds and then the cap band is separated from contact with the screen. The resulting image printed on the cap band has excellent detail with no distortion or fuzzy edges.

EXAMPLE II

For a bold letter design on a substrate, in the form of a cap, a coarser mesh screen, for example, of 110 line monofilament fabric is used since extremely fine detail is not required. Dark colored ink of the same type as in Example I is used. Air pressure at 6 psi is applied for approximately 1½ seconds, resulting in a bold letter design of good detail, but not as good as in Example I.

EXAMPLE III

The same screen mesh and ink composition are used to print a bold letter design in light colored ink on a substrate in the form of a cap. Air under 8 psi pressure is applied for approximately 2½ seconds. The resulting image is of substantially the same detail as in Example II, but not as good as in Example I. There is no distortion.

It will be understood by those in the art that if the substrate is composed of multi-filament fabric, that is, if it is cabled, the pressure applied to the ink mass and the time of application should be increased since it will require more force to push the ink through the cabled screen and onto the substrate.

Furthermore, an advantage of the present invention in which the ink is forced substantially vertically under constant pressure through the screen onto a substrate which is positioned directly vertically below the screen pattern is that any residual ink on the screen from a previous printing is placed in precisely the same intended position on the subsequently printed substrate. In other words, so-called "ghost images" are overprinted so that they are not easily visible to the naked eye. The application of air under constant pressure in a vertical direction over the entire image area or pattern results in substantially no image distortion since there is no movement or so-called "chatter" of the screen and/or substrate materials with respect to one another.

A second embodiment of the invention is shown in FIGS. 15–19. A direct printing apparatus A for printing an image on a substantially planar substrate, for example, an article of wearing apparel such as a T-shirt, comprises a substantially rectangular housing 122 with a plate 123 secured to a bracket 124 supported on a vertical post 125 secured in a sleeve 126 welded to a channel 128 forming a table or the like at a fixed distance from the floor. The housing 122, which is vertically adjustable on post 125 by screws 129, includes means for introducing air in the form of a hose 130 from a compressor into the housing through nipple 132 and a planar screen frame 134 with a screen 136 having an image to be directly printed on the substrate. The housing includes a plurality of interlocked longitudinal and lateral reinforcing ribs 138 for strength. A pressure relief valve may also be provided in the housing. The screen frame 134 is removably attached to the housing 122 by fasteners 140 along the edges of the screen frame for replacement and for charging ink onto the screen for direct printing.

A vertically adjustable plate or platen 142 is mounted on a post 144 which extends through a collar 146 having radial fins 148 welded to the channel 128 and is adapted to be raised or lowered by hand or automatically to bring an article of clothing on the platen into contact with the bottom surface of the screen 136 for direct printing of an image on the article. Although the platen 142 is rectangular, it may be any suitable shape. The article can be retained temporarily on the platen for printing by adhesive or by vacuum or other mechanical means, if desired.

The source and control of the air pressure in this second embodiment may be the same as earlier described with respect to the embodiments of FIGS. 1–12. Similarly, the viscous ink composition and supply may be identical to that used for printing caps. The essential difference between the two embodiments lies in the configuration of the substrate and printing screen, which in the case of a flat or planar substrate, requires a flat or planar screen. For example, the Newman Roller Frame is suitable for printing flat articles, for example, T-shirts or the like.

From the foregoing it is evident that direct printing according to the method and apparatus of the invention can be done by forcing ink through a pattern in a screen under predetermined appropriate constant air pressure for a suitable time. The configuration of the screen surface is designed to correspond to the configuration of the article to be printed. In other words, a curved screen is used to directly print a curved article such as a band of a hat or cap, and a flat screen is used to print an image on a substantially flat surface such as the front of a T-shirt. If it is desired to print an irregular surface, a correspondingly irregular configured screen can be used.

By systematically controlling the pressure of the air to maintain it constant to provide a controlled direct transfer of the ink through the screen to the substrate, a non-distorted, detailed image can be provided on or into the substrate according to the invention. The method and apparatus of the invention are not restricted to any given shape or type or composition of substrate or media. The machine and apparatus can be operated by hand semi-automatically or automatically to produce an image of a single color or multi-color using a single machine or a group of machines in which the article to be printed is moved from station to station by hand or automatically through appropriate indexing.

By using mandrels of different styles, i.e. flat, cylindrical or curved, different screen printing presses can be used or adapted to use the inventive method.

Although the invention has been described in terms of vertical and horizontal planes for convenience of description, with appropriate modification of the elements, for example, consistency of the ink used, the machine and/or apparatus could be used to print horizontally or at any angle to the horizontal.

The present invention eliminates the use of pads, squeegees or transfers for imaging an article with ink, eliminates distortion of the printed image and produces excellent detail in one color or a plurality of colors in a single design by direct printing. The method and apparatus employ constant air pressure for charging conventional inks through a conventional screen but does it in such a way as to achieve heretofore unrealized detail in the printing of images on substrates. Additionally, although the invention has been described in terms of printing articles of clothing, i.e. caps, hats, T-shirts, it is equally applicable to any substrate where a design, information, advertising or the like is desired, as for example, on containers, boxes, metal forms such as billets or blooms and machinery, although in such cases the detail of the image provided by the invention may be greater than needed.

Having described presently preferred embodiments of the invention, it is to be understood that they may otherwise be embodied within the scope of the appended claims.

I claim:

1. A method of printing indicia on successive substrates comprising:

(a) providing a pattern on a screen of a housing forming a gas chamber, said pattern corresponding to the indicia to be printed;

(b) providing a mass of ink in the form of a viscous composition on one surface of the screen within the housing;

(c) contacting a substrate to be printed to the opposite surface of the screen;

(d) providing a constant gas pressure to said ink within said gas chamber;

(e) forcing ink from said ink mass under said constant gas pressure for a predetermined time through said screen pattern and onto said substrate to directly print said indicia on said substrate;

(f) the pressure in said chamber being maintained at substantially the constant gas pressure between the printing of successive substrates.

2. The method as set forth in claim 1 wherein the ink is forced through the pattern under constant air pressure.

3. The method as set forth in claim 1 or claim 2 wherein the ink is in the form of a plastisol.

4. The method as set forth in claim 1 wherein a surface of the substrate is curved.

5. The method as set forth in claim 4 wherein the screen is curved to correspond with the curved substrate.

6. The method as set forth in claim 1 and separating said substrate from said screen for removal.

7. Apparatus for printing indicia on successive substrates comprising at least one printing machine having:

(a) means for mounting a substrate to be printed;

(b) means forming a gas chamber for mounting a screen for contact of one surface of the screen by said substrate during printing;

(c) ink in the form of a viscous composition on the opposite surface of said screen;

(d) means for providing a constant gas pressure to said ink within said gas chamber;

(e) means for forcing said ink under said constant gas pressure for a predetermined time through said pattern in said screen and onto said substrate to directly print said indicia thereon;

(f) the pressure in said chamber being maintained at substantially the constant gas pressure between the printing of successive substrates.

8. Apparatus as set forth in claim 7 wherein said substrate mounting means is adjustable relative to said screen.

9. Apparatus as set forth in claim 7 and including a closed housing for mounting the screen.

10. Apparatus as set forth in claim 9 wherein compressed air is introduced into said housing.

11. Apparatus as set forth in claim 10 wherein said means for forcing the ink through the pattern comprises air which is passed from a compressor through a regulator into said housing.

12. Apparatus as set forth in claim 7 wherein said ink is in the form of a plastisol.

13. Apparatus as set forth in claim 7 wherein substrate mounting means includes a curved mandrel and said screen includes a corresponding curved surface.

14. Apparatus as set forth in claim 7 wherein said substrate mounting means includes a substantially flat platen and said screen includes a corresponding flat surface.

15. Apparatus as set forth in claim 7 wherein said apparatus includes a plurality of individual machines for printing indicia in separate colors.

16. Apparatus as set forth in claim 15 wherein the machines are aligned substantially with each other and the substrate to be printed is moved from station to station.

17. Apparatus as set forth in claim 15 wherein the machines are arranged with others in a substantially circular manner and the substrate to be printed is moved from station to station.

18. Apparatus as set forth in claim 15 or claim 16 or claim 17 wherein means for drying the indicia previously applied to the substrate is interposed between at least two machines.

19. Apparatus as set forth in claim 18 wherein means for drying the indicia previously applied to the substrate is interposed between each of the plurality of machines.

20. Apparatus as set forth in claim 19 wherein said machines and means for drying are indexed to permit an operator to mount a substrate on at least one of the machines at a first station and index the device to a second station for printing of the indicia on a substrate.

* * * * *